United States Patent [19]

Brebner

[11] Patent Number: 4,650,184

[45] Date of Patent: Mar. 17, 1987

[54] SKI EXERCISER APPARATUS

[76] Inventor: Gordon Brebner, 25 Ellerby Sq. North, Woodbridge, Ontario, Canada, L4L 1N2

[21] Appl. No.: 753,026

[22] Filed: Jul. 8, 1985

[51] Int. Cl.[4] ..... A63B 69/18

[52] U.S. Cl. ..... 272/97

[58] Field of Search ..... 434/253; 272/97, 70, 272/146, 136, 138

[56] References Cited

U.S. PATENT DOCUMENTS

| | | | |
|---|---|---|---|
| 3,467,374 | 9/1969 | Auer | 272/97 |
| 3,511,499 | 5/1970 | Schawalder | 272/57 |
| 3,547,434 | 12/1970 | Ossenkop | 272/57 |
| 3,731,919 | 5/1973 | Schurch | 272/97 |

OTHER PUBLICATIONS

Brochure "Multi Purpose Ski Exerciser" Canadian Gymnasium Equipment Co. (undated).

*Primary Examiner*—Richard J. Apley

*Assistant Examiner*—S. R. Crow

*Attorney, Agent, or Firm*—Ridout & Maybee

[57] ABSTRACT

An exercise device has a foot platform supported on tracks in a frame for linear lateral movement, the movement of the platform being frictionally damped, as by a tensioned belt. The platform is tilted forward to constrain a user standing on the platform, and holding on to hand grips supported by an upwardly extending frame portion forwardly of the user, to assume an anticipation position with knees bent. The upward extending portion of the frame also has rearwardly extending bars to either side of the user's waist to restrict lateral body movement as the user projects the foot platform from side to side by leg movements. The platform movement is controlled by parallel links extending from the platform, parallel to the user's legs as seen from the front, and through pivotal connections to the upper part of the frame, the movement of the links through the pivots being controlled by springs and stops both so as to bias the platform towards a central position and so as to limit its outward travel along the tracks.

9 Claims, 5 Drawing Figures

SKI EXERCISER APPARATUS

This invention relates to exercise equipment, and more particularly equipment for exercising the legs.

In numerous sports, participants adopt a basic "anticipation" or readiness position, with the head up, the feet slightly apart, the knees bent to some degree, and the hands positioned to the front and side in anticipation. The participant in this position can move his body rapidly in any direction relative to his legs. Sports involved include hockey, football, soccer, baseball, basketball, tennis, squash and skiing. Whilst only the last of these is popularly associated with extensive lateral leg movement, in fact all of them can involve highly stressed lateral movements from an anticipation position. Conventional exercising devices however tend to exercise the legs and knees in conventional forward and backward movement. Ski exercisers have been proposed to provide lateral exercising movement, but none to the best of applicant's knowledge has met with widespread commercial acceptance, in the main because they fail properly to simulate skiing movements, or are excessively complex, or fail to constrain or arrest the user in achieving correct motion, or produce excessive mechanical noise.

It is believed that a successful device in this category needs to combine the following characteristics:

(a) it should provide constraint to lateral movement of the user's body to provide a reference relative to which lateral movement of the legs can be controlled;

(b) resistance to lateral movement should be progressive, and subject to sufficient damping to absorb energy at a desired rate;

(c) movements should not be subject to sudden arrest, since this is conducive both to noise production and to injury;

(d) there should be some visual feedback to provide an appropriate sense of motion; and (e) the apparatus should be relatively simple yet easily adjustable.

In U.S. Pat. No. 3,547,434, issued Dec. 15, 1970 to Robert J. Ossenkop, there is disclosed a ski exerciser in which a foot platform is laterally movable upon an arched track, being centred on the crown of the arched track by elastic straps. An apparatus similar to that shown in this patent is sold by Canadian Gymnasium Equipment Co. This device makes no attempt to control the body movements of the user, and the lateral resistance afforded by the arch and elastic straps are not believed to successfully simulate those inertial resistances encountered in skiing and like sports in moving out of the basic anticipation position, since the resistance afforded by the straps is essentially elastic and proportional to lateral displacement, and the gravitational energy developed by the weight of the user as the platform moves down the arch aids rather than resist lateral movement.

U.S. Pat. No. 3,511,499 issued May 12, 1970 to Schawalder adds a hand grip or grips to the general type of exerciser discussed above, in the form of a cross bar 1 or columns 32 or 49 to be gripped by the user's hands. There remains no control of the position of the user's body, nor any constraint to assume a correct anticipation position, other than the location of the hand grips forwardly of the platform. The FIG. 5 embodiment of this patent shows an arrangement in which the foot platform is supported for angular movement about a pivot. As such, it is believed to represent the embodiment of a misconception which affects many actual or proposed ski exercisers or simulators which provide for multidimensional pivoting and rolling movements of the user's feet whilst overlooking the fact that in real life most skiing movements are produced by the inertial reaction forces generated by lateral movements of a skier's body out of the basic anticipation position interacting with the skier's forward momentum and the lateral and vertical reactions of the skiing surface against the skis.

According to the invention, an exercise device comprises a base, a platform supported for lateral movement relative to the base, a frame having a portion extending upwardly from the base, means supported by the upwardly extending portion of the frame to restrict lateral movement of the waist of the user, hand grips supported by said upwardly extending frame portion forwardly and outwardly of the torso of the user, means for tilting the platform forwardly relative to the base, parallel links extending between laterally spaced points on the platform and laterally spaced points on the upwardly extending frame portion forwardly of the user, resilient means biasing the platform towards a central position relative to the stand and the frame, and means damping lateral movement of the platform.

Preferably the means for tilting the platform also tilts the frame, and preferably also the parallel links limit lateral movement of the frame.

Further features of the invention will become apparent from the following description of a preferred embodiment thereof with reference to the accompanying drawings.

Figure 1:
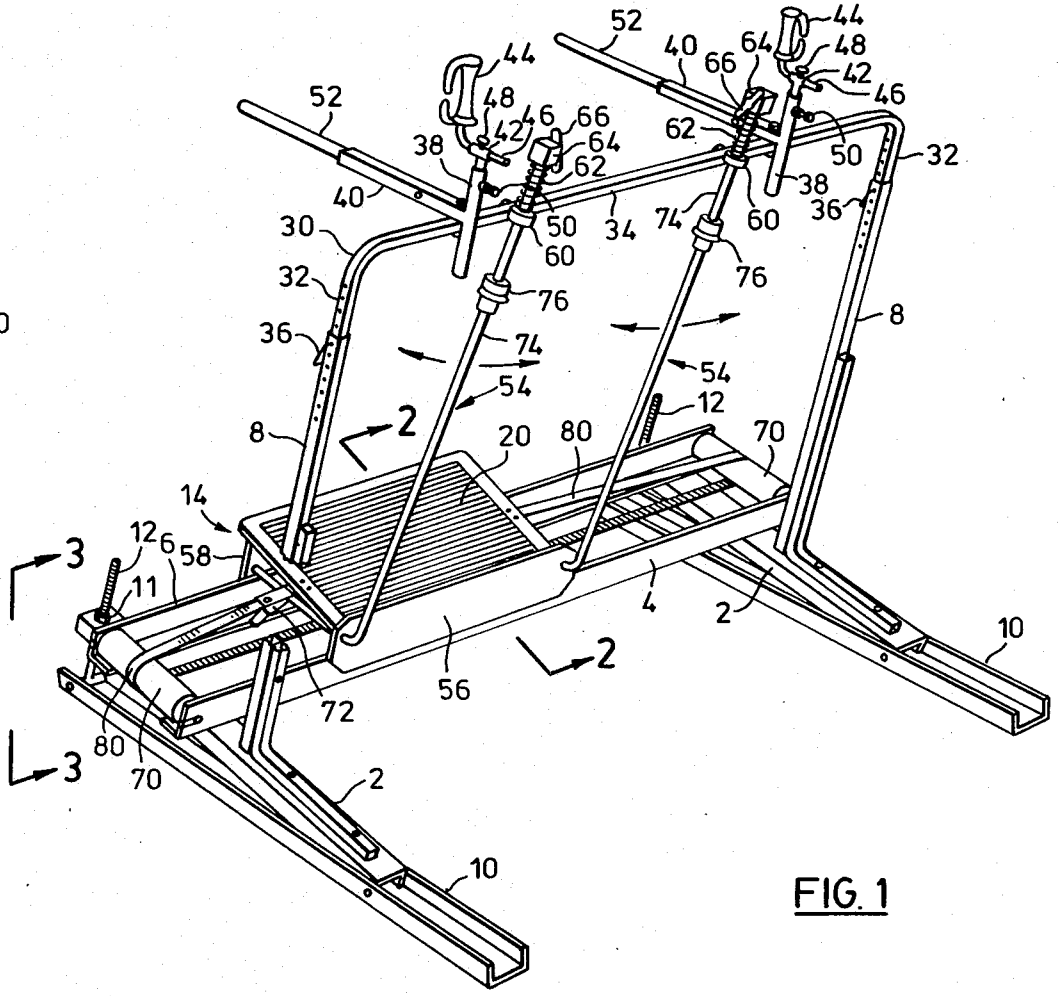
FIG. 1 is a perspective view from in front and one side of an apparatus in accordance with the invention.

Referring to FIG. 1, the apparatus has a main frame including side members 2, spaced parallel cross members 4 and 6 rigidly secured to the side members, and upright members 8 also rigidly secured to the side members. The side members 2 are pivotally connected at their forward ends to base members 10 and are also supported from the base members at their rear ends by nuts 11 on threaded studs 12 pivotally connected to the base members. By moving the nuts on the studs 12, the main frame may be tilted forward on the base by a desired amount, as discussed further below. The forward and rearward extent and the separation of the base members 10 is sufficient to provide a stable support for the main frame during use of the apparatus.

The cross members 4 and 6 are of L section and provide tracks for a laterally movable trolley 14 which is guided by vertical and lateral guide rollers 16 and 18. The trolley provides a platform 20 which is further inclined forwardly relative to the main frame, by virtue of brackets 22, 24, 26, 28 which support the rollers 16 and 18 being deeper at the rear of the platform than at the front.

An inverted U-shaped frame 30 has the stems 32 of the U shape received telescopically in the upright members 8, both the members 8 and the stems 32 being provided with spaced drillings so that the height of the cross bar portion 34 may be adjusted by inserting retainer pins 36 through appropriate sets of drillings. Secured to the cross bar 34 are vertically and rearwardly extending tubular members 38 and 40. Telescopically received in the members 38 are tee pieces 42 in turn supporting horizontal stems 46 supporting hand grips 44, the horizontal and vertical positions of which may be adjusted upon releasing clamping screws 48 and 50. The tubular members 40 house telescopically rearward extension bars 52.

The cross bar 34 is connected to the platform 20 by a parallelogram linkage formed by two L-shaped bars 54. The lower portion of each bar is journalled in front and rear walls 56 and 58 of the platform, and the stems 74 extend upwardly through plummer blocks 60 to permit axial and pivotal movement of the stems relative to the bar 34. Each stem consists of two telescopically engaged tubes locked together by a compression clamp 76. Compression springs 62 act between the plummer blocks and stop blocks 64 secured to the top end portions of the stems by clamping screws 66. Lateral movement of the trolley 20 on the tracks formed by cross members 4 and 6 is further controlled by a tension strap 80 of nylon of other high tensile webbing, extending in a loop from anchorages 68 on the platform and around rollers 70 journalled between opposite ends of the cross members 4 and 6. A tensioning device 72 is provided to tension the strap.

Prior to use, the device is adjusted to suit the physique and training regimen of the user. The height of the cross bar 34 is adjusted so that the telescopic extension bars 52 of the members 40 extend to either side of the waist of the user when standing on the platform 20 with the latter central and the knees bent in a basic anticipation position, the separation of the bars 52 being such as to severely restrict lateral movement of the waist of the user relative to the apparatus. It will of course be understood that alternative means such as harnesses could be employed to restrict lateral waist movement, but the arrangement described is simple both in construction and operation.

The positions of the hand grips are adjusted so as to bring them into positions which would be correct for the grips of ski sticks held by the user, and these positions are retained by tightening the clamping screws 48 and 50. The length of the stems 74 is adjusted to suit the height of the bar 34 so that a portion of each stem project above its associated plummer block 60, and the stop blocks 64 are positioned so that the springs 62 exert a desired centering force on the platform whilst becoming fully compressed before the platform 20 reaches either end of the tracks. It will be understood that as the platform moves laterally on the tracks out of a desired position, the stems 74 will move downwardly through the blocks 60 and compress the springs 62, thus generating a reaction force tending to centre the platform on the tracks.

The strap 80 is tensioned using the device 72 so that the friction developed in the roller bearings exercises a desired degree of frictional damping upon the lateral movement of the platform. It will be understood that alternative means to provide both spring centering of the platform and frictional drag on the platform could be utilized, but the spring arrangement described is effective, integrates well with the overall structure of the apparatus, and is accessible for adjustment by the user without leaving the platform. Moreover, it limits lateral movement of the trolley in a manner such as to cushion the stopping forces by the resilience of the frame 30 and thus undesirable noise and jarring of the user's kness. Likewise, the tension strap arrangement is simple and economical, and readily adjusted by the user.

The inclination or pitch of the main frame on the base members 10 is set by adjustment of the nuts 11 to throw the weight of the user forwardly by a desired amount.

Figure 3:
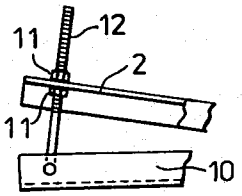
FIG. 3 is a fragmentary elevation from the line 3—3 in FIG. 1.
Figure 2:
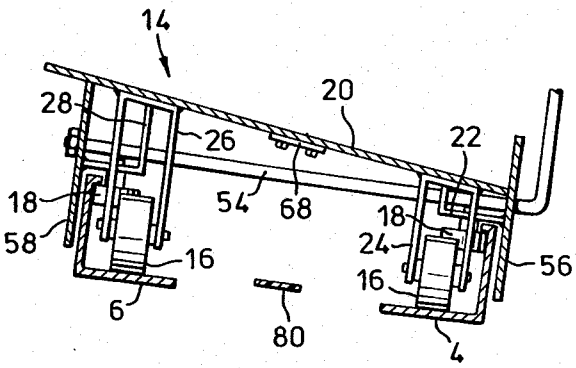
FIG. 2 is a vertical section on the line 2—2 in FIG. 1.
Figure 4:
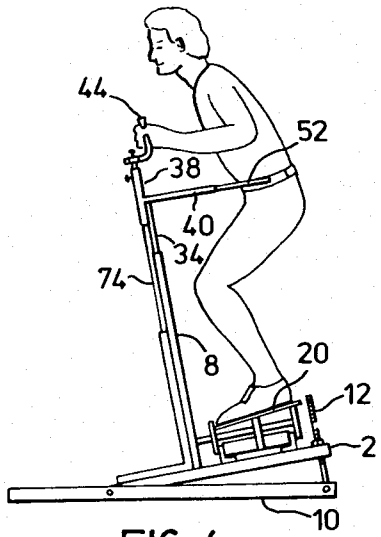
FIGS. 4 and 5 are side and front elevations illustrating the apparatus in use.
Figure 5:
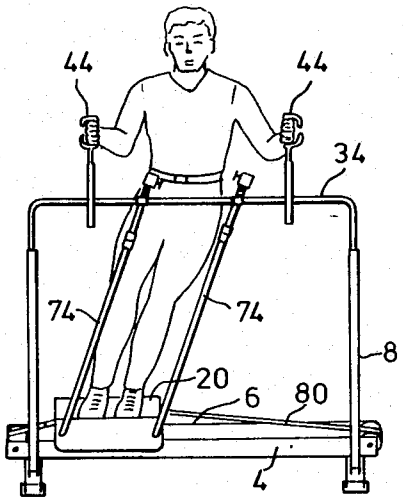

The overall effect of these adjustments is such that, when a user takes hold of the hand grips 44 and steps onto the platform with feet slightly apart, the user is induced to assume an "anticipation" position since the forward inclination of the platform will encourage bending of the legs at the knee. With the user's head up and the hands gripping the hand grips 44 (see FIG. 3), operation of the apparatus is then initiated by displacing the user's weight downwards by bending the knees forward. To go to the left, more weight is distributed to the left foot as the knees are compressed. To go to the right, more weight is distributed to the right foot as the knees are compressed. The motion to either left or right on the movable platform 20 is first resisted and finally stopped by compression of the springs 62 and the resistance of the frame 30. At the end of each lateral motion the user will unweight the knees. This unweighting will release the downward and lateral pressure on the movable platform 20 and the springs 62 allowing the platform and the user to move towards a centred position. The knees are then compressed again with the user's own weight to drive the platform in the opposite lateral direction. In the meanwhile, excessive body movement of the user is restrained by the bars 52. As the user becomes familiar with the rhythm of the apparatus, the user will eliminate the up/down motion and will roll the knees from left to right and vice versa in a parallel motion while the upper body remains quiet or still and the hands remain in an anticipation position. As the pitch of the main frame is increased by adjustment of the nuts 10, the user must bend the knees more to keep a correct body position over the platform 20. The exercise becomes more difficult to the user as the pitch is increased and also if the tension in the strap 80 is increased so as to increase the rate at which energy is absorbed from the apparatus.

The stems 74 at all times extend substantially parallel to the proper positions of the user's legs as seen from the front, from the toes to the hips (see FIG. 3), and the geometry of the moving portions of the apparatus relative to those portions controlling the torso position of the user is thus maintained by their parallelogram geometry. Furthermore, the lateral movement of the upper ends of the stems 74 provides a helpful visual indication of the user's own leg position. It should be borne in mind that in the many sports in which an anticipation position is adopted, this is to facilitate movement of the body relative to the feet, whereas most static exercising apparatus of necessity endeavours to provide for movement of the feet relative to the body. In skiing for example, the action of the skis is to restrain lateral movement of the feet whilst promoting forward movement, and the skier's body is moved relative to the legs. The ends of the stems 74 thus provide a visual reference which improves the illusion that the user is making body movements out of the anticipation position even though the body remains relatively stationary.

I claim:

1. An exercise apparatus comprising a base, a platform supported for lateral movement relative to the base, a frame having a portion extending upwardly from the base, means supported by the upwardly extending portion of the frame to restrict lateral movement of the waist of the user, hand grips supported by said upwardly extending frame portion forwardly and outwardly of the torso of the user, means for tilting the platform forwardly relative to the base, parallel links extending between laterally spaced pivots on the platform and laterally spaced pivots on the upwardly extending frame portion forwardly of the user, said parallel links coacting with resilient means connected in force transfer relationship between the platform and the upwardly extending frame portion to bias the platform towards a central position relative to the base and the frame, and means damping lateral movement of the platform.

2. An exercise apparatus according to claim 1, wherein the means for tilting the platform also tilts the frame.

3. An exercise apparatus according to claim 1, wherein the platform is supported for lateral movement by cross members forming linear tracks for the platform on the frame, wherein the extent of the parallel links between the pivots on the frame and the platform varies to accommodate lateral movement of the platform and, wherein means are provided to define the maximum extent of the links between said pivots whereby the extent of lateral movement of the platform on the tracks is limited.

4. An exercise apparatus according to claim 3, wherein the upper ends of the parallel links extend upwardly above the pivots on the upwardly extending portion of the frame wherein the pivots also permit axial motion of the links, and wherein said resilient means are compression springs acting between said pivots and stops secured to the links upwardly of said pivots, the stops providing means to defined the maximum extent of the links.

5. An exercise apparatus according to claim 1, wherein the means damping lateral movement of the platform is a frictional damper.

6. An exercise apparatus according to claim 3, wherein the means damping lateral movement of the platform is a friction damper acting between the platform and the frame.

7. An exercise apparatus according to claim 6, wherein the damping means comprises a belt extending from the platform around rollers journalled in the frame at each end of the track and back to the platform, and means to tension the belt to develop friction in the roller journals.

8. An exercise apparatus according to claim 3, wherein the parallel links, seen in front elevation, are located to extend parallel to the legs of a user standing on the platform, from toes to hips.

9. An exercise apparatus according to claim 3, wherein the parallel links are the stem portions of L-shaped members, the lower portions of which extend rearwardly through and are journalled in the platform to form the pivots on the latter.

* * * * *